US007804255B2

(12) United States Patent
Ostrovsky et al.

(10) Patent No.: US 7,804,255 B2
(45) Date of Patent: Sep. 28, 2010

(54) DIMMING SYSTEM POWERED BY TWO CURRENT SOURCES AND HAVING AN OPERATION INDICATOR MODULE

(75) Inventors: Michael Ostrovsky, Brooklyn, NY (US); Parimal R. Patel, Holbrook, NY (US); Eugene Frid, Great Neck, NY (US)

(73) Assignee: Leviton Manufacturing Company, Inc., Little Neck, NY (US)

( * ) Notice: Subject to any disclaimer, the term of this patent is extended or adjusted under 35 U.S.C. 154(b) by 401 days.

(21) Appl. No.: 11/927,093

(22) Filed: Oct. 29, 2007

(65) Prior Publication Data

US 2009/0027219 A1 Jan. 29, 2009

Related U.S. Application Data

(60) Provisional application No. 60/962,080, filed on Jul. 26, 2007.

(51) Int. Cl.
*H05B 41/36* (2006.01)

(52) U.S. Cl. ..... 315/291; 315/194; 315/DIG. 4; 323/905; 323/325

(58) Field of Classification Search ..... 315/200 R, 315/206, 208, 287, 291, 362, 129, 119, 224, 315/307, 194; 323/220, 226, 235, 905, 325, 323/318

See application file for complete search history.

(56) References Cited

U.S. PATENT DOCUMENTS 3,309,571 A 3/1967 Gilker
3,538,477 A 11/1970 Walters et al.
3,702,418 A 11/1972 Obenhaus (Continued)

FOREIGN PATENT DOCUMENTS

DE 28 21 138 11/1978

(Continued)

OTHER PUBLICATIONS

PCT Transmittal of International Search Report and Written Opinion for PCT/US2008/070774 filed Jul. 22, 2008, mailed Feb. 12, 2009.

*Primary Examiner*—Douglas W Owens
*Assistant Examiner*—Ephrem Alemu
(74) *Attorney, Agent, or Firm*—Carter, DeLuca, Farrell & Schmidt, LLP

(57) ABSTRACT

A dimming system and method of operating the same are provided. The dimming system includes a first terminal configured to operatively connect to a first conductive line, a second terminal configured to operatively connect to a second conductive line, and a third terminal configured to operatively connect to a third conductive line. The first conductive line is configured to connect to a load, the second conductive line is configured to supply an alternating current, and the third conductive line is configured to connect to a current path. The dimming system further includes a controller operatively connected to at least one of the first, second and third terminals for controlling operation of the dimming system. The first and second terminals are configured for electrically connecting to a primary power supply and the first and third terminals are configured for electrically connecting to a secondary power supply. The primary power supply is powered through connection to neutral, and wherein the secondary power supply is powered through connection to an earth ground.

21 Claims, 5 Drawing Sheets

U.S. PATENT DOCUMENTS

| | | | |
|---|---|---|---|
| 3,766,434 | A | 10/1973 | Sherman |
| 3,813,579 | A | 5/1974 | Doyle |
| 3,864,649 | A | 2/1975 | Doyle |
| 3,872,354 | A | 3/1975 | Nestor et al. |
| 3,949,336 | A | 4/1976 | Dietz |
| 4,002,951 | A | 1/1977 | Halbeck |
| 4,010,431 | A | 3/1977 | Virani |
| 4,010,432 | A | 3/1977 | Klein |
| 4,013,929 | A | 3/1977 | Dietz et al. |
| 4,034,266 | A | 7/1977 | Virani et al. |
| 4,034,360 | A | 7/1977 | Schweitzer, Jr. |
| 4,051,544 | A | 9/1977 | Vibert |
| 4,063,299 | A | 12/1977 | Munroe |
| 4,109,226 | A | 8/1978 | Bowling |
| 4,114,123 | A | 9/1978 | Grenier |
| 4,159,499 | A | 6/1979 | Bereskin |
| 4,163,882 | A | 8/1979 | Baslow |
| 4,194,231 | A | 3/1980 | Klein |
| 4,223,365 | A | 9/1980 | Moran |
| 4,288,768 | A | 9/1981 | Arnold et al. |
| 4,316,230 | A | 2/1982 | Hansen |
| 4,377,837 | A | 3/1983 | Matsko |
| 4,386,338 | A | 5/1983 | Doyle |
| 4,409,574 | A | 10/1983 | Misencik |
| 4,412,193 | A | 10/1983 | Bienwald et al. |
| 4,442,470 | A | 4/1984 | Misencik |
| 4,515,945 | A | 5/1985 | Ranken et al. |
| 4,518,945 | A | 5/1985 | Doyle |
| 4,521,824 | A | 6/1985 | Morris |
| 4,538,040 | A | 8/1985 | Ronemus |
| 4,567,456 | A | 1/1986 | Legatti |
| 4,568,899 | A | 2/1986 | May |
| 4,574,260 | A | 3/1986 | Franks |
| 4,578,732 | A | 3/1986 | Draper |
| 4,587,588 | A | 5/1986 | Goldstein |
| 4,595,894 | A | 6/1986 | Doyle et al. |
| 4,630,015 | A | 12/1986 | Gernhardt et al. |
| 4,631,624 | A | 12/1986 | Dvorak |
| 4,641,216 | A | 2/1987 | Morris et al. |
| 4,641,217 | A | 2/1987 | Morris et al. |
| 4,686,600 | A | 8/1987 | Morris et al. |
| 4,719,437 | A | 1/1988 | Yun |
| 4,802,052 | A | 1/1989 | Brant et al. |
| 4,814,641 | A | 3/1989 | Dufresne |
| 4,816,957 | A | 3/1989 | Irwin |
| 4,851,951 | A | 7/1989 | Foster, Jr. |
| 4,874,962 | A | 10/1989 | Hermans |
| 4,901,183 | A | 2/1990 | Lee |
| 4,949,070 | A | 8/1990 | Wetzel |
| 4,967,308 | A | 10/1990 | Morse |
| 4,979,070 | A | 12/1990 | Bodkin |
| 5,144,516 | A | 9/1992 | Sham |
| 5,148,344 | A | 9/1992 | Rao |
| 5,161,240 | A | 11/1992 | Johnson |
| 5,179,491 | A | 1/1993 | Runyan |
| 5,185,687 | A | 2/1993 | Beihoff et al. |
| 5,202,662 | A | 4/1993 | Bienwald |
| 5,218,331 | A | 6/1993 | Morris et al. |
| 5,223,810 | A | 6/1993 | Van Haaren |
| 5,224,006 | A | 6/1993 | MacKenzie et al. |
| 5,229,730 | A | 7/1993 | Legatti |
| 5,239,438 | A | 8/1993 | Echtler |
| 5,293,522 | A | 3/1994 | Fello et al. |
| 5,323,088 | A | 6/1994 | Cunningham |
| 5,363,269 | A | 11/1994 | McDonald |
| 5,418,678 | A | 5/1995 | McDonald |
| 5,448,443 | A | 9/1995 | Muelleman |
| 5,477,412 | A | 12/1995 | Neiger et al. |
| 5,510,760 | A | 4/1996 | Marcou et al. |
| 5,515,218 | A | 5/1996 | DeHaven |
| 5,517,165 | A | 5/1996 | Cook |
| 5,541,800 | A | 7/1996 | Misencik |
| 5,555,150 | A | 9/1996 | Newman, Jr. |
| 5,576,580 | A | 11/1996 | Hosoda et al. |
| 5,594,398 | A | 1/1997 | Marcou et al. |
| 5,600,524 | A | 2/1997 | Neiger et al. |
| 5,617,284 | A | 4/1997 | Paradise |
| 5,625,285 | A | 4/1997 | Virgilio |
| 5,637,000 | A | 6/1997 | Osterbrock et al. |
| 5,654,857 | A | 8/1997 | Gershen |
| 5,655,648 | A | 8/1997 | Rosen |
| 5,661,623 | A | 8/1997 | McDonald et al. |
| 5,680,287 | A | 10/1997 | Gernhardt |
| 5,694,280 | A | 12/1997 | Zhou |
| 5,699,243 | A | 12/1997 | Eckel et al. |
| 5,706,155 | A | 1/1998 | Neiger et al. |
| 5,710,399 | A | 1/1998 | Castonguay et al. |
| 5,715,125 | A | 2/1998 | Neiger |
| 5,729,417 | A | 3/1998 | Neiger et al. |
| 5,757,145 | A | 5/1998 | Johnson et al. |
| 5,805,397 | A | 9/1998 | MacKenzie |
| 5,815,363 | A | 9/1998 | Chu |
| 5,825,602 | A | 10/1998 | Tosaka |
| 5,844,765 | A | 12/1998 | Kato |
| 5,847,913 | A | 12/1998 | Turner et al. |
| 5,875,087 | A | 2/1999 | Spencer et al. |
| 5,877,925 | A | 3/1999 | Singer |
| 5,917,686 | A | 6/1999 | Chan |
| 5,920,451 | A | 7/1999 | Fasano et al. |
| 5,933,063 | A | 8/1999 | Keung et al. |
| 5,943,198 | A | 8/1999 | Hirsh et al. |
| 5,946,209 | A | 8/1999 | Eckel et al. |
| 5,949,197 | A | 9/1999 | Kastner |
| 5,956,218 | A | 9/1999 | Berthold |
| 5,963,408 | A | 10/1999 | Neiger et al. |
| 6,021,034 | A | 2/2000 | Chan |
| 6,040,967 | A | 3/2000 | DiSalvo |
| 6,052,265 | A | 4/2000 | Zaretsky et al. |
| 6,180,899 | B1 | 1/2001 | Passow |
| 6,204,743 | B1 | 3/2001 | Greenberg et al. |
| 6,226,161 | B1 | 5/2001 | Neiger et al. |
| 6,232,857 | B1 | 5/2001 | Mason, Jr. et al. |
| 6,242,993 | B1 | 6/2001 | Fleege et al. |
| 6,246,558 | B1 | 6/2001 | DiSalvo et al. |
| 6,252,407 | B1 | 6/2001 | Gershen |
| 6,255,923 | B1 | 7/2001 | Mason, Jr. et al. |
| 6,259,340 | B1 | 7/2001 | Fuhr et al. |
| 6,282,070 | B1 | 8/2001 | Ziegler et al. |
| 6,288,882 | B1 | 9/2001 | DiSalvo et al. |
| 6,309,248 | B1 | 10/2001 | King |
| 6,381,112 | B1 | 4/2002 | DiSalvo |
| 6,381,113 | B1 | 4/2002 | Legatti |
| 6,437,700 | B1 | 8/2002 | Herzfeld et al. |
| 6,437,953 | B2 | 8/2002 | DiSalvo et al. |
| D462,660 | S | 9/2002 | Huang et al. |
| 6,545,574 | B1 | 4/2003 | Seymour et al. |
| 6,590,753 | B1 | 7/2003 | Finlay |
| 6,646,838 | B2 | 11/2003 | Ziegler et al. |
| 6,657,834 | B2 | 12/2003 | DiSalvo |
| 6,671,145 | B2 | 12/2003 | Germain et al. |
| 6,813,126 | B2 | 11/2004 | DiSalvo et al. |
| 6,864,766 | B2 | 3/2005 | DiSalvo et al. |
| 6,969,959 | B2 * | 11/2005 | Black et al. ..... 315/307 |
| 7,049,911 | B2 | 5/2006 | Germain et al. |
| 7,546,473 | B2 * | 6/2009 | Newman ..... 323/208 |
| 7,573,208 | B2 * | 8/2009 | Newman, Jr. ..... 315/294 |
| 7,619,365 | B2 * | 11/2009 | Davis et al. ..... 315/112 |
| 2005/0063110 | A1 | 3/2005 | DiSalvo et al. |
| 2006/0125323 | A1 | 6/2006 | Ostrovsky et al. |
| 2006/0139132 | A1 | 6/2006 | Porter et al. |
| 2006/0255746 | A1 * | 11/2006 | Kumar et al. ..... 315/209 R |

2007/0126366 A1 6/2007 Frid

FOREIGN PATENT DOCUMENTS

| | | |
|---|---|---|
| DE | 34 31 581 | 11/1991 |
| EP | 081 661 | 6/1983 |
| ES | 21345 | 5/1977 |
| FR | 2391549 | 12/1978 |
| GB | 227930 | 1/1925 |
| GB | 830018 | 9/1960 |
| GB | 2207823 | 8/1989 |
| GB | 2292491 | 2/1996 |
| JP | 61-259428 | 11/1986 |
| WO | PCT/US99/19319 | 8/1999 |
| WO | PCT/US00/2295 | 1/2000 |
| WO | PCT/US01/32562 | 10/2001 |

* cited by examiner

DIMMING SYSTEM POWERED BY TWO CURRENT SOURCES AND HAVING AN OPERATION INDICATOR MODULE

PRIORITY

This patent application claims priority to and the benefit of the previously filed U.S. Provisional Patent Application No. 60/962,080 entitled, "DIMMER SWITCH HAVING AN OPERATION INDICATOR AND A GROUND LEAKAGE POWER SUPPLY," filed on Jul. 26, 2007.

BACKGROUND

1. Technical Field

The present disclosure relates to dimming systems or dimmer switches, and, in particular, to a dimming system or dimmer switch powered by two current sources. Additionally, the present disclosure relates to a dimming system or dimmer switch having an operation indicator module for indicating at least one operating condition. Further, the present disclosure relates to a method for connecting the dimming system to a load and the two current sources, which includes an alternative return path (e.g., an earth ground), for powering the dimming system.

2. Description of Related Art

Many countries have an electric grid infrastructure that uses alternating current as a power source (referred to herein as an "AC source"). These systems can be either balanced or unbalanced and may include one or more phases, e.g., a three-phase AC source may include a first line that provides a zero phase AC source, a second line that provides a 120-degree phase AC source, a third line that provides a 240-degree phase AC source, and a return path (usually referred to as a "neutral" line). The "neutral" line can be used as a return path for the AC source supplied by the first, second, and third lines. A line is a conductive path that can also be referred to as a "wire". The terms "line", "conductive line", and "wire" are considered herein to be synonymous.

However, many AC wiring systems (e.g., those found in typical dwellings) also utilize an alternative return path called an earth ground. The earth ground, sometimes confusingly referred to simply as "the ground," is generally used as a safety feature by providing an alternative return path to the return path provided by the neutral line. The earth ground may be formed by several conductive rods that are sufficiently driven into the earth. A sufficient number of rods of sufficient length are used to provide a high current capacity conductive connection to the earth with relatively low impedance.

To illustrate the advantages of using an electric wiring system that uses an earth ground, consider the following: consider a line that provides an AC source (i.e. a "hot" line) that becomes damaged and/or dislodged, thus touching the metal housing of an AC outlet. The AC outlet may become electrified, or "hot". Any person that touches the metal housing of the AC outlet may form a complete circuit from the AC source through that person's body to the earth (the earth is for all practical purposes an infinite electron source and an infinite electron sink). To prevent this from occurring, the metal housing may be conductively connected to that earth ground, thus effectively forming a wired connection to the earth. With the added safety feature of an earth ground if a "hot" line touches a "grounded" metal housing (such as a metal housing of an AC outlet), the current will increase until a circuit protection device detects the rapid rise in current and interrupts the AC source. Modern electrical systems use circuit breakers that automatically detect unsafe current levels by monitoring the magnetic field created by the AC source and/or by monitoring heat that results from the energy dissipated by the flowing electrons.

Many dwellings and office buildings use either a single-phase, two-phase, or three-phase AC source and/or some combination thereof. The AC source may be accessed by standardized connections (referred to as "plugs") that prevent a user from improperly connecting to an AC source, e.g., a three-phase AC plug cannot connect to a two-phase AC outlet. Additionally, many AC sources may selectively apply electricity to a load based upon whether a switch is turned on or off, e.g., a light switch.

It is well known how to control the brightness of a light by using a dimming system (or dimming switch) that is connected between a hot line and a load line (the load line connects to the load while the load is also connected to the neutral line, thus forming a complete circuit). These dimming systems are usually powered from current flowing between the hot line to the load via the load line, and consequently through the load and the neutral line. Typical dimming systems do not have a direct connection to the neutral line. This allows a dimming system to be quickly and easily installed as a replacement for a mechanical on/off switch because these dimmer switches do not require an additional wire directly connected to the neutral line.

Because the two-line dimming system controls the power dissipation of the load by utilizing a TRIAC, SCRs, MOSFETs, JGBTs and the like power switches, the dimming system turns off these power switches at a small portion of every half cycle of an AC source and uses this time to charge the power supply to power its various components. The human eye does not see or perceive these interruptions of power to the load.

There are at least two drawbacks associated with the prior art two-line dimming systems. First, since the load affects how much power can be provided to the dimming system, two-line dimming systems have a minimum power load requirement. If the load power rating (or maximum power dissipation) is less than the minimum power load requirement (typically less than 25-40 W), the dimming system gets inadequate power to operate causing the dimming system to stop working. Another drawback of two-line dimming systems is that if the load gets burned out the two-line dimming system cannot power itself (e.g., the primary conductive path of the load forms an open circuit).

In both of these two situations, the dimming system's components, including its processor (e.g., microcontroller), cannot be powered up and the dimming system stops operating. Without an adequate power supply (or power source), the dimming system is not capable of providing an indication to the user that the dimming system is operating properly and the problem lies elsewhere. Accordingly, it would be beneficial to the user to know that the two-line dimming system is not broken or malfunctioning. Providing such an indication technique can facilitate a user's determination as to whether the load is burned out or as to whether the load's power rating is too low for the dimming system to operate. This will reduce the amount of service calls and unnecessary replacements of two-line dimming systems or dimming switches.

SUMMARY

The present disclosure relates to dimming systems, and, in particular, to a dimming system or dimmer switch and method for utilizing a current path or an alternative return path (e.g., an earth ground) to provide power to the dimming system.

In one aspect of the present disclosure, a dimming system or dimmer switch is provided which includes first, second, and third terminals. The first terminal is operatively connected to a first conductive line. The first conductive line is configured to connect to a load, e.g., a load line. The second conductive line is operatively connected to a second conductive line. The second conductive line is configured to supply an alternating current, such as from a single-phase AC source. The third terminal is operatively connected to a third conductive line. The third conductive line is configured to connect to the alternative return path, e.g., an earth ground. The dimming system further includes a control module (e.g., a controller), a primary power supply, and a secondary power supply.

The control module controls the dimming system while the primary and secondary power supplies each, at least partially, supply power to the control module. The primary power supply is operatively connected to the first and second terminals and the secondary power supply is operatively connected to the first and third terminals. The secondary power supply may include a current limiter that limits the current that flows between the second and third terminals, for example, to about 0.5 milliamps. Furthermore, a switching module or switch may be included that is operatively connected to the first and second terminals, and controls power dissipation of the load. The switching module may be controlled by the control module.

In another aspect thereof, the primary and secondary power supplies each have an energy storage module. The energy storage module may store energy using a capacitor, an inductor, a battery, and/or some combination thereof. The secondary power supply stores energy in the energy storage module by using the current flowing between the second and third terminals.

In another aspect thereof, the control module may include a condition detection module. The condition detection module detects at least one operating condition, such as a low-load condition, an open-circuit condition, and a switching module malfunction condition. The low-load condition may be predetermined to exist when the load has maximum power dissipation from a first predetermined level, for example, about 25 watts, up to a second predetermined level, for example, about 40 watts. The open circuit condition exists when at least one conductive path of the load forms an open circuit, e.g., the load is "burned out".

In another aspect thereof, the control module further includes an operation indicator module for indicating to a user the operating condition detected by the condition detection module. For example, the operation indicator module may indicate to a user a low-load condition, an open-circuit condition, a switching module malfunction condition, and/or some combination thereof The operation indicator module may utilize an LED, an LED display, a Radio Frequency module, an Infrared module, an audio indicator module, a conductive line signal-interface module, and combinations thereof for indicating the at least one detected operating condition.

In another aspect thereof, the control module further includes at least one processor. The at least processor operatively communicates with the condition detection module and the operation indicator module. The at least one processor can operate in one or more of the following operating states: a normal operating state, a low-power state, a startup state, a power-up state, a standby state, a programming state, a condition handling state, a charging state, a discharging state, a communication state, and a sleep state. The at last one processor can receive an actuation signal from a discrete actuation assembly (e.g., a paddle switch) and/or a variable actuation assembly (e.g., a radial knob).

The at least one processor can receive via the actuation signal a programming-mode request sequence for placing the at least one processor in the programming state for programming at least one operating parameter of the dimming system or dimmer switch. When the at least one processor operates in the programming state, at least one operating parameter can be programmed. The at least one operating parameter can include a minimum brightness level parameter, a maximum light level parameter, a fade rate parameter, a preset level parameter, a communication parameter, a remote control enable parameter, and/or an access network programming mode enable parameter.

In yet another aspect thereof, a method for connecting a dimming system to a load and two current sources is provided. The method includes connecting a first terminal of the dimming system to a first conductive line. The first conductive line is electrically connected to said load. The method further includes connecting a second terminal of the dimming system to a second conductive line. The second conductive line is configured for supplying an alternating current from a first current source. The method also includes connecting a third terminal of the dimming system to a third conductive line. The third conductive line is configured for supplying current from a second current source.

The method further includes, during operation of the dimming system, detecting at least one operating condition and indicating the at least one operating condition to a user. The step of indicating the at least one operating condition includes powering an operation indicator module which may include at least one of an LED, an LED display, a radio frequency module, and infrared module, an audio indicator module, and a conductive line signal-interface module. The at least one operating condition may include at least one of a low-load condition, an open-circuit condition, and a switching module malfunction condition.

BRIEF DESCRIPTION OF THE DRAWINGS

These and other advantages will become more apparent from the following detailed description of the various embodiments of the present disclosure with reference to the drawings wherein.

DETAILED DESCRIPTION

Figure 1:
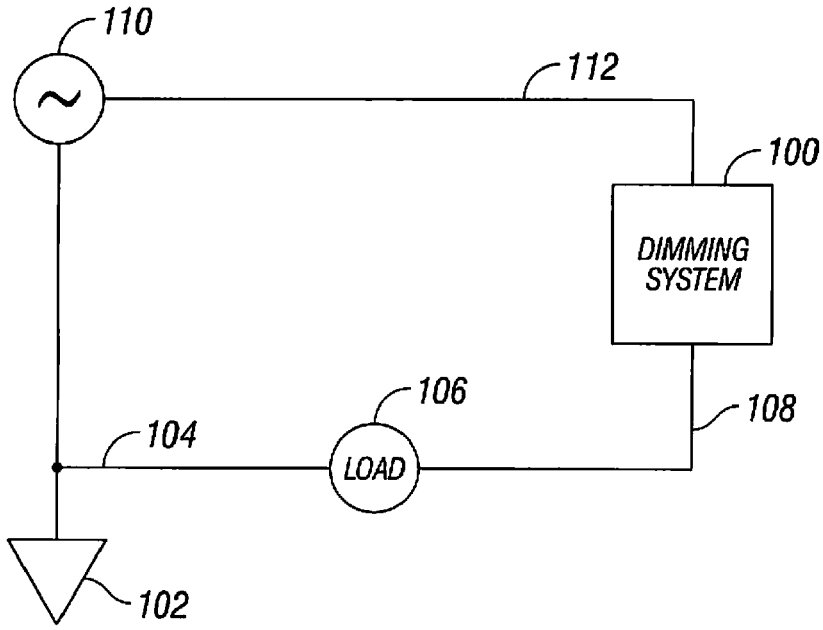
FIG. 1 (Prior Art)
FIG. 1 is a prior art dimming system that has a power supply connected to a hot line and a load line.

Referring to the drawings, FIG. 1 shows a prior art dimming system 100 that is indirectly connected to neutral 102 via neutral line 104 through load 106 and finally via load line 108. In some contexts, connections to neutral 102 is confusedly referred to as a "ground" connection (or simply as "ground"), however, herein the term "neutral" is used to refer to a typical "neutral" line that is part of common wiring schemes, and the term "earth ground" refers to a conductive connection to a typical alternative return path found in most wiring schemes. This alternative path is usually an actual conductive connection to the earth. However, in some wiring configurations, the neutral line and the earth ground line may be connected together at some point, perhaps via an electrical fuse, to prevent the two references from having too large of a voltage disparity (i.e., too large of a "float").

The neutral 102 partly forms a return path or current path for the current that travels from AC source 110 via hot wire or line 112 through dimming system 100 and through load 106 via load wire or line 108 and eventually to neutral 102 via neutral wire or line 104. This forms a "close circuit", or a complete conductive path for charge flow to occur, e.g., electron flow. FIG. 1 illustrates some of the aspects of typical prior art dimming systems.

Consider the following: consider the case in which dimming system 100 includes a mechanism to control the power dissipation of load 106 by "chopping" the current coming from AC source 110. AC source 110 may provide a voltage source that swings from about −110 volts to about 110 volts forming a complete cycle about 60 times a second (i.e. 60 Hertz). AC source 110 may be a single-phase AC source and may form an approximate sinusoidal wave when comparing the voltage (or current) to time. As the AC voltage reaches zero and continues to increase on the "up swing" of the AC cycle, dimming system 100 may break the connection between hot line 112 and load line 108 when a certain voltage level is reached. The connection may be reestablished as the AC voltage is on the "down swing" and then broken again. This rapid on/off activity results in an oscillation between an open circuit and a close circuit condition. This is a way to control the aggregate power dissipation of load 106. If load 106 were an incandescent light bulb, depending on the power dissipated, the "brightness" of the light bulb is affected, hence the term "dimming system".

Figure 2:
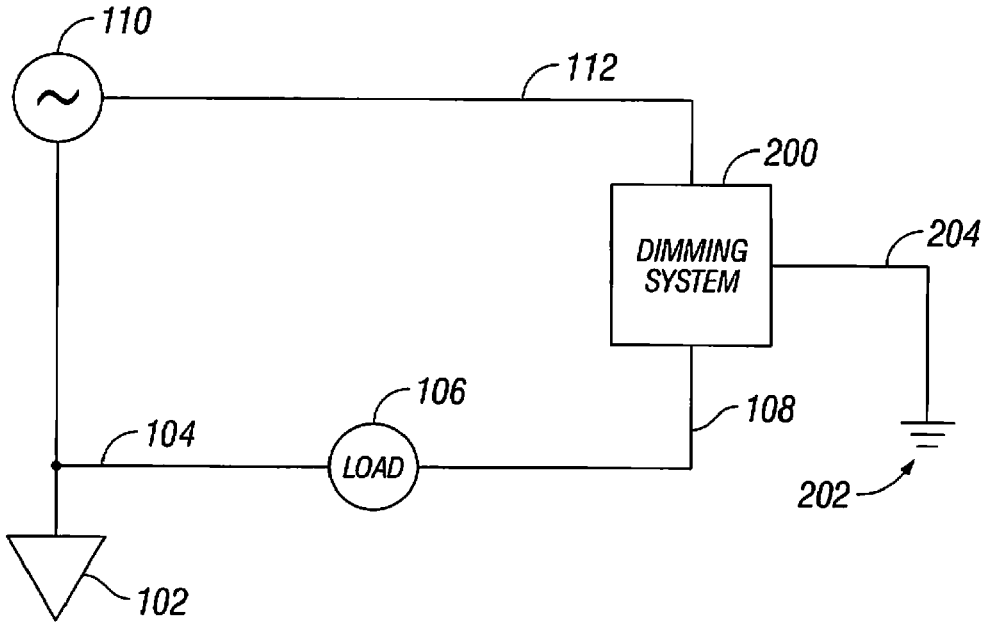
FIG. 2 is a block diagram of a dimming system that includes a secondary power supply connected to a current path or an alternative return path (e.g., earth ground), the secondary power supply uses the current that flow between the hot line and the alternative return path to at least partially supply power to the dimming system, in accordance with the present disclosure.
Figure 3:
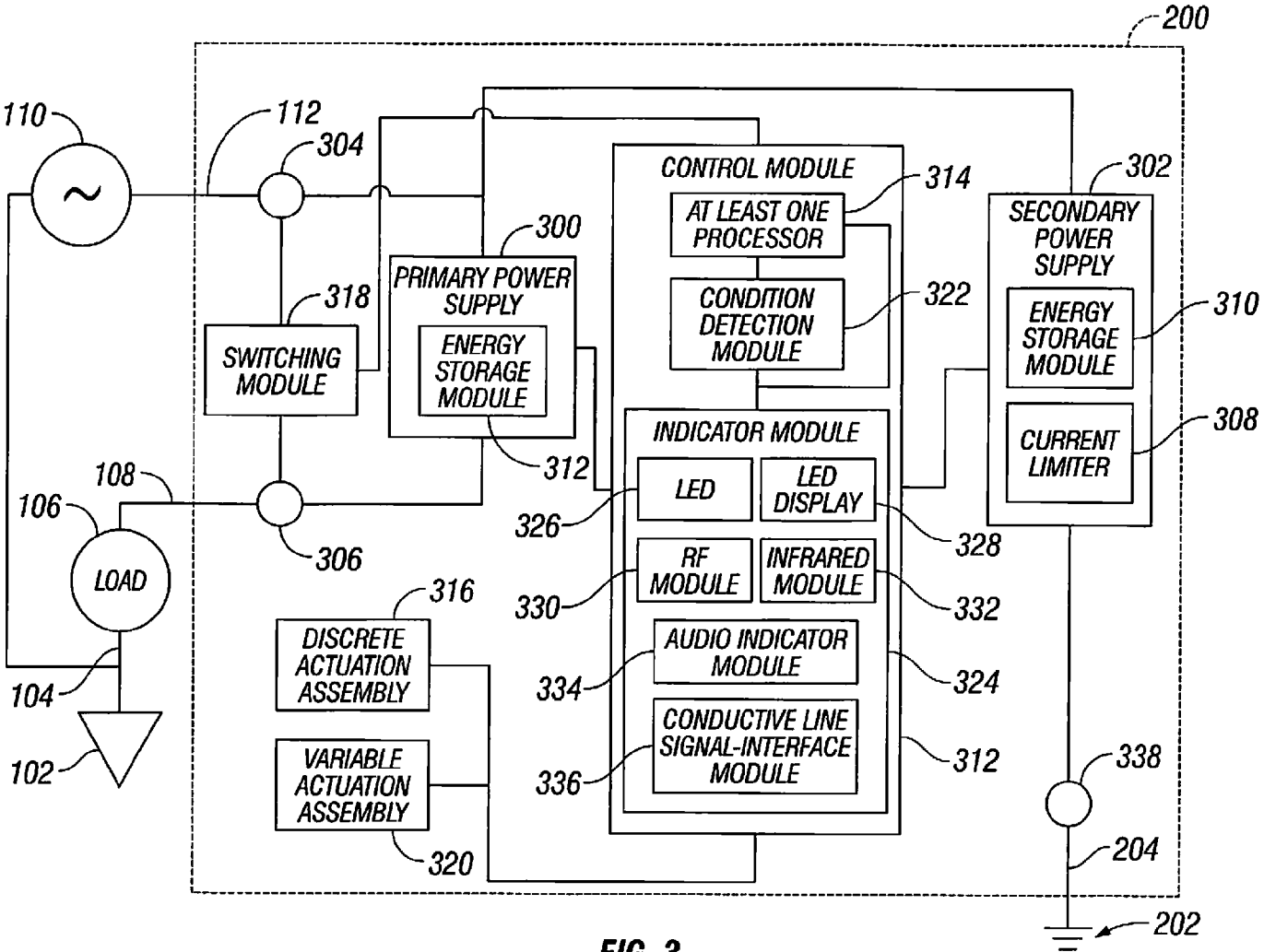
FIG. 3 is a more detailed block diagram illustration of the dimming system of FIG. 2, in accordance with the present disclosure.

Referring to the drawings, FIG. 2 shows a dimming system 200 that has an operation indicator and an alternative power supply (not shown in FIG. 2, however, these features are shown in more detail in FIG. 3). The operation indicator enables a user to know that the dimming system is operating properly or if there is one of a low-load condition, an open-circuit condition, and a switching module malfunction condition. An open-circuit condition occurs when load 106 is damaged, e.g., a burned out light bulb. Additionally or alternatively, a low-load condition may occur because the maximum power dissipation of load 106 is too low resulting in dimming system 200 having a difficult time (1) effectively controlling load 106 and/or (2) supplying sufficient internal power for proper operation. The information is provided to the user to give the user more information to make an informed decision regarding whether or not to trouble shoot dimming system 200. Dimming system 200 uses AC source 110 and neutral 102 and is similar to dimming system 100 of FIG. 1, however, note that in FIG. 2, dimming system 200 has a current path or an alternative return path to earth ground 202. The alternative return path is partly formed by earth ground line 204. As mentioned supra, earth ground 202 may be a physical connection to the earth, e.g., via copper rods driven into the ground.

Referring to the drawings, FIG. 3 shows a more detailed block diagram illustration of dimming system 200 in accordance with the present disclosure. Dimming system 200 includes primary power supply 300 and secondary power supply 302. Power supplies 300 and 302 may be a switched-mode power supply, a rectified signal with a linear voltage regulator, and/or any other hardware, software or firmware or circuitry that can be configured to supply electrical energy. Dimming system is powered primarily by primary power supply 300 (i.e., the main power supply) which derives power from the voltage differential between hot wire 112 and load wire 108. Hot wire 112 is connected to dimming system 200 via terminal 304 while load wire 108 is connected to dimming system 200 via terminal 306. However, dimming system 200 additionally derives power from secondary power supply 302, which derives power from the voltage differential between hot wire 112 and ground earth line 204. The secondary power supply 302 may also be referred to as a ground leakage power supply, because the current flowing there between is essentially "ground leakage current" because it is a use of the safety ground connection (earth ground 202) to supply power to dimming system 200 during normal and abnormal (e.g., a burned out load or an insufficient power provided to the dimmer switch) operating conditions. Alternatively, the secondary power supply 302 may be reserved for use only during abnormal operating conditions, e.g., when a low load condition, an open circuit condition, and/or a switching module malfunction condition is detected.

Dimming system 200 may be configured to prevent overuse of earth ground line 204 by limiting the amount of current flowing there through. For example, secondary power supply 302 may include current limiter 308 that limits the maximum amount of current that flows within earth ground line 204 to about 0.5 milliamps of AC current. This limitation may be because of regulatory restrictions and/or wiring standard limitations. Additionally or alternatively, secondary power supply 208 may include energy storage module 310 and/or primary power supply 300 may include energy storage module 312. Energy storage modules 310 and 312 may include a capacitor, an inductor, a battery, and/or some combination thereof to provide energy storage.

Dimming system 200 also includes control module or controller 312 for controlling the overall operation of dimming system 200. This may be accomplished by using at least one processor 314. At least one processor 314 may be a microcontroller, a microprocessor, a virtual machine, an ASIC chip (application specific integrated circuit), a CPLD chip (complex programmable logic device), a FPGA chip (field programmable gate array), implemented in software, implemented in hardware, implemented in firmware and/or combinations thereof.

At least one processor 314 may be implemented as a state machine and may operate in one or more states. Each state may be implemented as a software routine, and/or may be an interrupt, e.g., hardware interrupt. At least one processor 314 may be in a normal operating state (i.e., dimming function working properly), a low-power state (i.e. a state that conserves energy), a start-up state (e.g., a hot reboot), a power-up start (e.g., a cold reboot), a standby state, (i.e., awaiting further input and/or operation), a programming state (i.e., system parameters may be changed), a condition handling state (e.g., using an algorithm to handle a low-load condition), a charging state (e.g., charging up energy storage module 310), a discharging state (e.g., using the energy stored in energy storage module 310), a communication state (e.g., communicating using the X10 protocol), and a sleep state (e.g., the at least one processor 314 is asleep). At least one processor 314 may operate in each state exclusively or may operate in multiple states simultaneously.

Consider normal operating conditions in which at least one processor 314 operates in the normal operating state. A user may use discrete actuation assembly 316 (e.g., a paddle switch) that informs control module 312 to control switching module 318 to apply electric current to load 106. Switching module 318 may be configured to control power dissipation of load 106. A user may then utilize variable actuation assembly 320 to vary the "brightness" of load 106, in this example load 106 being a light bulb. Variable action assembly 320 may be a slide, a circular knob, a potentiometer, and/or other continuous or quasi-continuous actuation mechanism. Primary power supply 300 may be charging energy storage module 312 while secondary power supply 302 may be charging energy storage module 310. Secondary power supply 302 may also be limiting the current flowing via earth ground line 204, for example, to about 0.5 milliamps, by using current limiter 308.

Control module 312 includes condition detection module 322 capable of monitoring the operation of dimming system 200. Condition detection module can detect various operating conditions, such as a low-load condition, an open-circuit condition, and switching module malfunction condition. The detected operating condition can be communicated by condition detection module 322 to at least one processor 314, which decides how to handle the operating condition. The at least one processor 314 can then operate in the condition handling state mentioned supra. The at least one processor 314 can implement part of or all of method 500, discussed infra, and may instruct operation indicator module 324 to indicate the detected condition to the user. The operation indicator module 324 may be implemented in hardware, software, firmware, and/or combinations thereof.

Additionally or alternatively, operation indicator module 324 may include LED 326, LED display 328, radio frequency (referred to herein as "RF") module 330, infrared module 332, audio indicator module 334, and/or conductive line signal-interface module 336. LED 326 and LED display 328 indicate the condition to the user visually, while audio indicator module 334 indicates the condition to via sound. RF module 330, infrared module 322, and conductive line signal-interface module 336 indicate the condition to the user via communicating the condition to another electrical device. For example, conductive line signal-interface module 336 may connect to hot line 112, load line 108, earth ground line 204, or other wire, and may modulate a message on the wire using sub-carrier multiplexing, such as an X10 protocol.

Abnormal operating condition of dimming system 200 uses the current flowing within earth ground line 204 as a power supply source to power the dimming system's internal circuitry (especially control module 312) via the secondary power supply 308. Dimming system 200 can instruct operation indicator module 324 to inform the user of the abnormal operating condition with respect to load 106.

Operation indicator module 324 can include a visual indicator, such as, for example, one or more LEDs (e.g., LED 326) which may be controlled by the at least one processor 314 to blink a particular blinking pattern associated with a particular type of abnormal operating condition, or LCD display 328 or other type of display for displaying a message or error code to the user; audio indicator module 334, such as, for example, a speaker and associated circuitry for sounding an alarm or voicing a message to the user; a transmission module in operative communication with at least one processor 314 for transmitting signals to a local or remote controller associated with dimming system 200 where the signals can be RF, infrared, electrical signals capable of being transmitted by power lines, data signals capable of being transmitted wirelessly and by data cables, etc. and where the signals can be embedded with short messages; and/or and some combination thereof.

In operation, as described above and with reference to FIG. 3, dimming system 200 according to the present disclosure is powered by two power supplies: primary power supply 300 (see FIG. 3) which provides power to dimming system 200 using the current that travels through the hot line 112 and load 106 which is connected to neutral line 104, and secondary power supply 302 which provides power to dimming system 200 using the current that travels through the hot line 112 and earth ground line 204. Switching module 318 may operatively control the power dissipation of load 106 by utilizing TRIACs, SCRs, MOSFETs JGBTs and/or other suitable switching device, for operating dimming system 200.

Additionally or alternatively, consider the following scenario: when a load 106 is properly attached and the maximum power dissipation of the load 106 is greater than the minimum acceptable maximum power dissipation requirement of dimming system 200, there is sufficient power capacity to properly supply power to load 106 for proper operation of dimming system 200 (e.g., normal operating state). In this state, primary power supply 300 provides the biggest portion of power for operating dimming system 200 while secondary power supply 302 provides a small portion of the operating power. Additionally, during the normal operating state, secondary power supply 302 supplies a "power supply" capacitor (found within energy storage module 310) with current using the small amount of current traveling through earth ground line 204, thereby charging the power supply capacitor.

If a loss of primary power supply 300 is detected by condition detection module 322, control module 312 enters the low-power state. In this state, dimming system 200 may stop controlling the load, i.e., instructing switching module 318 to cause the power dissipation of load 106 to be about zero, and uses the energy stored within the "power supply" capacitor (within energy storage module 310), which was previously charged using the secondary power supply 302, to power control module 312 and other components of dimming system 200 including at least one processor 314. According to this type of detected condition as described above, the user is accordingly informed of the abnormal operating condition with respect to load 106. Additionally or alternatively, secondary power supply 302 may be disabled while the primary power supply 300 is utilized and then enabled when the loss of the primary power supply 300 is detected by condition detection module 322.

The at least one processor 314 of dimming system 200, running in the low power state, can control the intervals on how often the one or more LEDs (e.g., LED 326) blink, how often the alarm is sounded by the audio indicator module 334, a message is voiced by audio indicator module 334, and/or signals are transmitted to inform the user of the abnormal operating condition by indicator module 324 (e.g., RF module 330, Infrared Module 332, and/or conductive line signal-interface module 336). The at least one processor 314 may be operated during the low power state by utilizing the energy stored by the "power supply" capacitor that may be in energy storage module 310 and/or energy storage module 312. Once the energy is used to power the components of dimming system 200 during the low power mode, the components may become non-operational and the "power supply" capacitor needs to be charged again using current that flows through earth ground line 204 via secondary power supply 302 before the dimming system 200 initiates the next cycle by powering the various components using the energy stored by the capacitor for informing the user via operation indicator module 324.

Figure 4A:
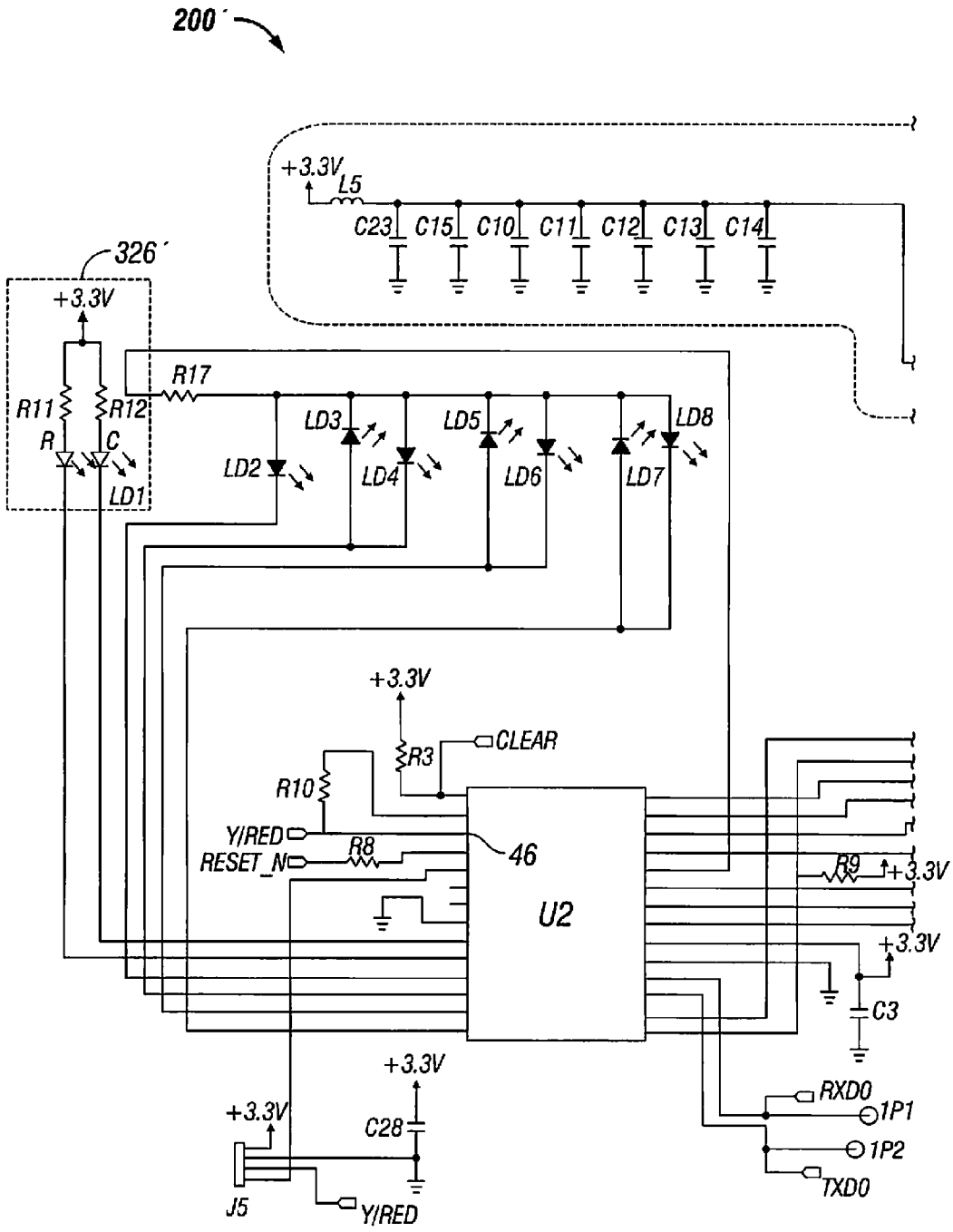
FIGS. 4A and 4B are schematic drawings of a dimming system with a Radio Frequency module that includes a Radio Frequency microchip, in accordance with the present disclosure.
Figure 4B:
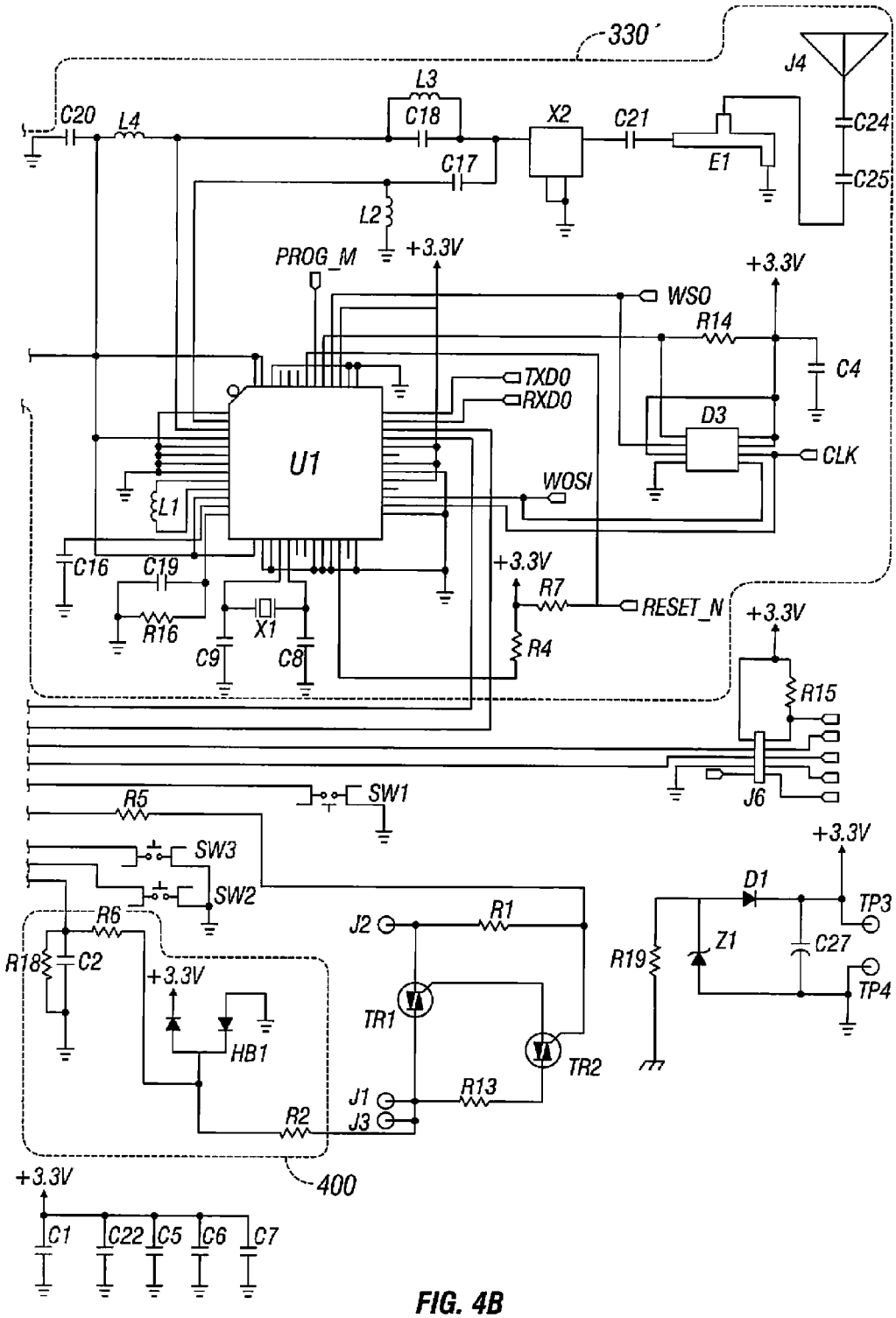

Referring to FIGS. 4A and 4B, a schematic of dimming system 200' is shown that is designed to operate similarly to dimming system 200 described above. Dimming system 200' has RF communication capabilities. The schematic is representative of the VIZIA™ RF dimming system or dimmer switch designed by Leviton Manufacturing Co., Inc., Little Neck, N.Y.

In order for microcontroller U2 (which is part of at least one processor 314 as shown in FIG. 3) of the VIZIA™ RF dimming system 200' to properly function during the low power state, during manufacture of dimming system 200', all pins of the microcontroller U2 are set at an appropriate mode/setting to consume as little power as possible (e.g., all internal pull-ups are disconnected, all peripheral components are turned off, RF chip U1 is configured to be reset at a appropriate times, etc.).

The VIZIA™ RF dimming system 200' has a primary power supply and a secondary power supply. After the voltage at the primary power supply line reaches a voltage level needed to power the microcontroller U2, the microcontroller U2 starts operating at a low frequency (~32 kHz). The microcontroller U2 then checks to determine if the primary power supply is available. On the schematic shown by FIG. 4, the microcontroller U2 checks to determine if the primary power supply is available by checking the zero crossing line 400. However, when the load is burned out, there is no zero crossing signal promulgating through the zero crossing line 400. This is because zero crossing is taken from the load wire connection of dimming system 200'. If there is no zero crossing signal promulgating through the zero crossing line 400, the microcontroller U2 actuates LEDs 326' (note that there are two LED's in FIG. 4A, while LED 326 in FIG. 3 is shown as one, multiple LEDs are considered to be equivalent to one LED). Operation indicator module 324 (see FIG. 3), is shown in FIG. 4A as LEDs 326' and RF module 300' is also shown with the proper accompanying circuitry. Therefore, actuation thereof can include, for example, short blink every four seconds for letting the user know that the dimming system 200' is functioning properly and that the problem is with the load. LEDs 326' can be RED for clearly being viewed by the user in different ambient light conditions.

In another mode of operation of dimming system 200' according to the present disclosure, instead of (or in addition to) blinking LEDs 326', the microcontroller U2 can initiate a signal transmission through RF chip U1 (part of RD module 330'). This is done by the microcontroller U2 releasing RF chip U1 from reset by pulling reset pin 46 "HIGH" and bringing the other line connecting microcontroller U2 to RF chip U1 to "LOW" to indicate an abnormal operating condition corresponding to the load. Sensing the reset pin 46 HIGH and the other connecting line LOW, RF chip U1 transmits a status message, such as, for example, "LAMP is burned", and then goes into a sleep state to forego consuming additional power. Additionally or alternatively, any condition referred to herein may be transmitted as well.

When the microcontroller U2 starts a new cycle, it resets RF chip U1 to cancel the sleep state. Note that the sleep state and the low power state may exist simultaneously and may be inclusive. Accordingly, RF chip U1 retransmits the status message (e.g., a condition) and then goes into the sleep state, and so on. This method of operation continues until the main power supply is restored to the dimming system 200'.

When main power supply is restored, a zero crossing signal is detected by the microcontroller U2 of dimming system 200' when it checks the zero crossing line 400 and proceeds to the normal operating state; the microcontroller U2 checks for used input, controls the load, communicates with other devices on network, etc.

Dimming systems 200 and/or 200' can include user programming features as known in the art for dimmer switches. This may occur when at least one processor 312 is placed into a programming state. The programming features typically include adjusting minimum/maximum light levels, fade rates, preset levels to which the dimmer switch is turned on, etc. Additionally, dimming systems 200 and 200' may include communication capability usually have some special programming modes for joining or leaving a network, for switching to factory default parameters and for adjusting multiple communication parameters, e.g., a communication state.

Generally, since a dimming system's programming features are used infrequently, dimming systems are not provided with special programming actuators. The dimming systems are designed to be programmed using the available dimmer controls (ON/OFF control paddle, DIM/BRIGHT control buttons) after a user accesses a programming mode (via placing the at least one processor 314 into a programming state). The ON/OFF control paddle is a type of discrete actuation assembly while the DIM/BRIGHT control button may be either a pair of discrete actuation assemblies or a variable actuation assembly.

Dimming systems are typically designed to have some protection against an accidental access of a programming mode (i.e., the programming state) during normal operation of the dimming system. For example, the ACENTI™, VIZIA™ and TouchPoint™ dimmer switches (i.e., dimming systems) commercially available from Leviton Manufacturing Co., Inc. have a limited time window after power-up in which a programming mode can be accessed. These dimming systems or dimmer switches use a combination of an air gap switch (safety switch) which disconnects power from the DIM/BRIGHT control buttons and from the ON/OFF control paddle. During this time, the user can access one of the programming modes by holding for a predetermined amount of time (e.g., a few seconds) the ON/OFF control paddle. If the ON/OFF control paddle is pressed and held for a few seconds when the dimmer switch is operating normally, the air gap switch will prevent the user from accessing a programming mode of the dimmer switch or dimming system.

Dimming systems 200 and 200' of FIGS. 2-4B may have a secondary power supply 302 that prevents a system reset when the air gap switch is open. Consider one way to access a programming mode in which a user can activate for a predetermined amount of time one or more controls which are not used together during normal operation of dimming systems 200 and 200'. For example, the user can simultaneously push and hold ON/OFF control paddle and the DIM or BRIGHT control button for a predetermined amount of time, simultaneously push and hold the DIM and BRIGHT control buttons for a predetermined amount of time, or push and hold the BRIGHT control button for a predetermined amount of time.

While in a programming mode, the DIM/BRIGHT control buttons can be used to change the operating parameters of dimming systems 200 and 200' and the ON/OFF control paddle can be pushed and held for skipping through the different programming modes and for switching dimming systems 200 and 200' to a normal operating state.

For a dimming system that has RF communication capabilities, e.g., dimming system 200' and RF module 330 of dimming system 200, simultaneously pushing and holding the ON/OFF control paddle and the DIM control button can cause access to local programming modes, e.g., the programming modes which includes a programming mode for changing the minimum brightness level; and simultaneously pushing and holding the ON/OFF control paddle and the BRIGHT control button causes the dimming system to access network programming modes, e.g., the programming modes which includes a programming mode for enabling and disabling remote control of the dimming system 200, 200'.

Figure 5:
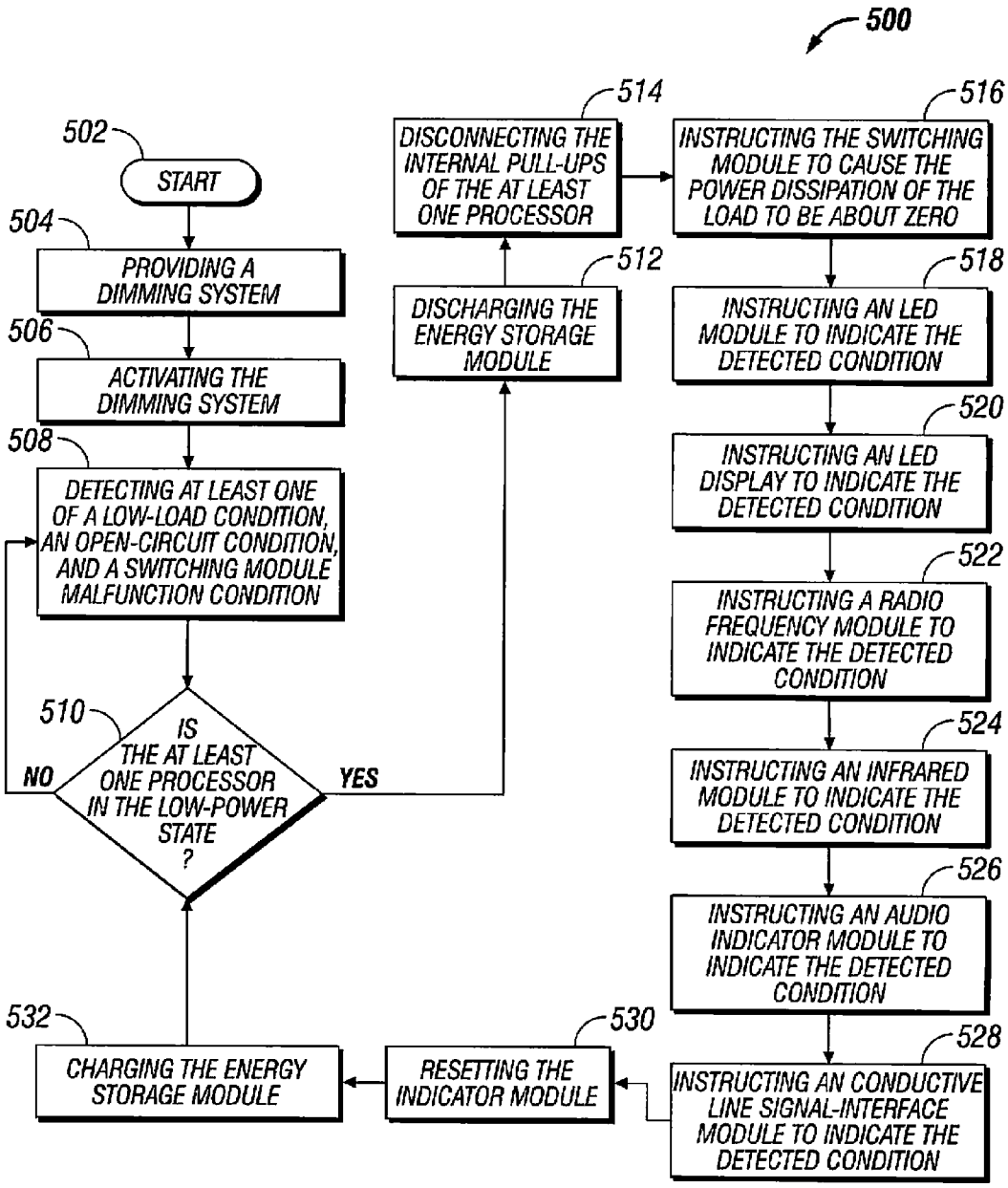
FIG. 5 is a flow chart depiction of a method that provides a dimming system that utilizes an alternative return path, e.g., earth ground, in accordance with the present disclosure.

Referring to the drawings, FIG. 5 shows a flow chart depiction of a method 500 that provides a dimming system that utilizes an alternative return path such as an earth ground for powering the dimming system in accordance with the present disclosure. Method 500 begins at START 502 and continues to step 504 which includes providing a dimming system (e.g., dimming system 200 and/or dimming system 200' of FIGS. 2-4B). Step 506 provides for activating the dimming system. Step 508 provides for detecting at least one of a low-load condition, an open-circuit condition, and a switching module malfunction condition. The at least one processor (e.g., at least one processor 314 of FIG. 3) can assist in detecting the one or more conditions in step 508.

Step 510 determines if the at least one processor of the dimming system is in the low-power state. The low-power state may be a result of a detected condition in step 508 and/or may be intentionally induced for some other reason. If the at least one processor is not in the low-power state, step 508 is repeated, or, if the at least one processor is in the low power state, step 512 is performed and the energy storage module is discharged. The energy storage module can be used to supplement an insufficient amount of operating power for powering the dimming system.

Method 500 also includes step 514 for disconnecting the internal pull-ups of the at least one processor. Step 516 instructs the switching module to cause the power dissipation of the load to be about zero. Steps 514 and 516 may be used to conserve the total power reserves of the dimming system. At least one of steps 518 through 528 occurs alone or simultaneously with one or more of the other steps of 518 through 528, and entail communicating or instructing parts of an indicator module, (e.g., indicator module 324 of FIG. 3) for notifying a user of an operating condition of the dimming system.

Step 518 entails instructing an LED module to indicate the detected condition as detected during step 508. Step 520 entails instructing an LED display to indicate the detected condition. Step 522 entails instructing a radio frequency module to indicate the detected condition. Step 524 entails instructing an audio indicator module to indicate the detected condition. Step 528 entails instructing a conductive line signal-interface module to indicate the detected condition (e.g., an X10 interface).

Method 500 may continue to step 530 for resetting the operation indicator module 324 and then may proceed to step 532 for charging the energy storage module, e.g., energy storage module 312. The method then continues to step 510 and can repeat indefinitely.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A dimming system comprising:

a first terminal configured to operatively connect to a first conductive line, wherein the first conductive line is configured to connect to a load;

a second terminal configured to operatively connect to a second conductive line, wherein the second conductive line is configured to supply an alternating current;

a third terminal configured to operatively connect to a third conductive line, wherein the third conductive line is configured to connect to a current path;

a controller operatively connected to at least one of the first, second and third terminals for controlling operation of the dimming system;

a primary power supply operatively connected to the first and second terminals; and a secondary power supply operatively connected to the first and third terminals, wherein the secondary power source is a separate power supply from the primary power supply and is powered through at least one different connection than the primary power supply.

2. The system according to claim 1, further comprising a switching module operatively connected to the first and second terminals, and wherein the switching module is configured to control power dissipation of the load.

3. The system according to claim 2, wherein the primary power supply is powered through connection to neutral, and wherein the secondary power supply is powered through connection to an earth ground.

4. The system according to claim 1, wherein at least one of the primary power supply and the secondary power supply are part of said dimming system, and wherein at least one of the primary power supply and the secondary power supply include an energy storage module, wherein the energy storage module includes at least one of a capacitor, an inductor, and a battery.

5. The system according to claim 1, wherein the controller comprises a condition detection module configured to detect at least one operating condition of said dimming system.

6. The system according to claim 5, wherein the at least one operating condition is at least one of a low-load condition, an open-circuit condition, and a switching module malfunction condition.

7. The system according to claim 1, wherein the controller further comprises an operation indicator module configured to indicate at least one operating condition of said dimming system.

8. The system according to claim 7, wherein the at least one operating condition is at least one of a low-load condition, an open-circuit condition, and a switching module malfunction condition.

9. The system according to claim 7, wherein the operation indicator module indicates the at least one operating condition by utilizing at least one of an LED, an LED display, an Radio Frequency module, an Infrared module, an audio indicator module, and a conductive line signal-interface module.

10. The system according to claim 1, wherein the secondary power supply comprises a current limiter configured to limit the current flowing between the second and third terminals.

11. The system according to claim 1, wherein the controller further comprises at least one processor, and wherein the at least one processor is configured to operatively communicate with a condition detection module for detecting at least one operating condition of said dimming system.

12. The system according to claim 11, wherein the at least one processor is configured to receive an actuation signal from at least one of at least one discrete actuation assembly and at least one variable actuation assembly, and wherein the at least one processor operates in the programming state when a programming-mode request sequence is received via the actuation signal.

13. The system according to claim 12, wherein at least one system parameter can be programmed during operation of the at least one processor in the programming state.

14. The system according to claim 13, wherein the at least one system parameter is selected from the group consisting of a minimum brightness level parameter, a maximum light level parameter, a fade rate parameter, a preset level parameter, a communication parameter, a remote control enable parameter, and an access network programming mode enable parameter.

15. A method for connecting a dimming system to a load and two current sources comprising:

electrically connecting a first terminal of said dimming system to a first conductive line, wherein the first conductive line is electrically connected to said load;

electrically connecting a second terminal of said dimming system to a second conductive line, wherein the second conductive line is configured for supplying an alternating current from a first current source; and electrically connecting a third terminal of said dimming system to a third conductive line, wherein the third conductive line is configured for supplying current from a second current source, wherein the second current source is a separate current source from the first current source and is powered through at least one different connection than the first current source.

16. The method according to claim 15, further comprising operating said dimming system and detecting at least one operating condition.

17. The method according to claim 16, further comprising indicating the at least one operating condition to a user.

18. The method according to claim 17, wherein the indicating step comprises powering an operation indicator module having at least one of an LED, an LED display, a radio frequency module, an infrared module, an audio indicator module, and a conductive line signal-interface module.

19. The method according to claim 16, wherein the at least one operating condition includes at least one of a low-load condition, an open-circuit condition, and a switching module malfunction condition.

20. The method according to claim 16, further comprising causing the power dissipation of the load to be about zero following detection of at least one operating condition.

21. The method according to claim 15, further comprising charging an energy storage module using at least one of the first and second current sources.

* * * * *